US011602247B2

(12) United States Patent
Ge et al.

(10) Patent No.: US 11,602,247 B2
(45) Date of Patent: Mar. 14, 2023

(54) FOLDABLE FOOT BATH DEVICE

(71) Applicant: HUAIAN MIMIR ELECTRIC APPLIANCE CO., LTD., Huaian (CN)

(72) Inventors: Jun Ge, Huaian (CN); Sucheng Cao, Huaian (CN); Jianguo Chen, Huaian (CN)

(73) Assignee: HUAIAN MIMIR ELECTRIC APPLIANCE CO., LTD., Huaian (CN)

( * ) Notice: Subject to any disclaimer, the term of this patent is extended or adjusted under 35 U.S.C. 154(b) by 0 days.

(21) Appl. No.: 17/643,420

(22) Filed: Dec. 9, 2021

(65) Prior Publication Data

US 2022/0095846 A1 Mar. 31, 2022

Related U.S. Application Data

(63) Continuation of application No. PCT/CN2021/098122, filed on Jun. 3, 2021.

(30) Foreign Application Priority Data

Aug. 28, 2020 (CN) ..... 202021835266.5
Oct. 24, 2020 (CN) ..... 202011150807.5
(Continued)

(51) Int. Cl.
*A47K 3/062* (2006.01)
*A61H 35/00* (2006.01)

(52) U.S. Cl.
CPC ..... *A47K 3/062* (2013.01); *A61H 35/006* (2013.01)

(58) Field of Classification Search
CPC ..... A47K 3/062; A47K 3/06; A47K 3/064; A47K 3/07; A47K 3/074; A47K 3/162;
(Continued)

(56) References Cited

U.S. PATENT DOCUMENTS 618,442 A * 1/1899 Shearer ..... B65D 37/00 220/904
1,097,690 A 5/1914 Ward
(Continued)

FOREIGN PATENT DOCUMENTS

CN 2300361 Y 12/1998
CN 2482407 Y 3/2002
(Continued)

*Primary Examiner* — Erin Deery
(74) *Attorney, Agent, or Firm* — Bayramoglu Law Offices LLC

(57) ABSTRACT

A foldable foot bath device includes a support rod, an upper frame, a base, and a basin wall connected between the upper frame and the base. A cover plate is arranged on the upper frame. The basin wall is made of flexible material and foldable. When the basin wall is unfolded to form a foot bath area, the basin wall is supported by the support rod. The support rod is located in the space surrounded by the basin wall, and an upper end of the support rod is rotatably connected to the cover plate. The support rod is supported between the cover plate and the bottom side of the base after the basin wall is unfolded, thereby forming the support for the basin wall. The support rod is flipped and then approaches the cover plate after the basin wall is folded.

19 Claims, 19 Drawing Sheets

(30) Foreign Application Priority Data

| | | |
|---|---|---|
| Nov. 3, 2020 | (CN) | 202011208676.1 |
| Nov. 20, 2020 | (CN) | 202022702038.7 |
| Apr. 27, 2021 | (CN) | 202120879149.7 |
| Apr. 27, 2021 | (CN) | 202120879167.5 |

(58) Field of Classification Search
CPC ..... A47K 3/164; A47K 3/022; A61H 35/006; B65D 21/086; B65D 21/0068; B65D 1/0292
See application file for complete search history.

(56) References Cited

U.S. PATENT DOCUMENTS

| | | | | |
|---|---|---|---|---|
| 8,607,375 | B2 * | 12/2013 | Yeung | A47K 3/06 4/585 |
| 9,918,896 | B2 * | 3/2018 | Tsang | A61H 33/026 |
| 2005/0076433 | A1 * | 4/2005 | Leung | A61H 35/006 4/622 |
| 2005/0257318 | A1 * | 11/2005 | Perkins | A61H 33/6089 4/622 |
| 2018/0255978 | A1 * | 9/2018 | Los | A47K 3/064 |

FOREIGN PATENT DOCUMENTS

| | | | |
|---|---|---|---|
| CN | 202537102 | U | 11/2012 |
| CN | 104287662 | A | 1/2015 |
| CN | 206026180 | U | 3/2017 |
| CN | 206924031 | U | 1/2018 |
| CN | 208740819 | U | 4/2019 |
| CN | 209285294 | U | 8/2019 |
| CN | 209499552 | U | 10/2019 |
| CN | 211049207 | U | 7/2020 |
| CN | 211212829 | U | 8/2020 |
| CN | 211212830 | U | 8/2020 |
| CN | 112244675 | A | 1/2021 |
| CN | 112244676 | A | 1/2021 |
| CN | 112386144 | A | 2/2021 |
| CN | 213309350 | U | 6/2021 |

* cited by examiner

FOLDABLE FOOT BATH DEVICE

CROSS REFERENCE TO THE RELATED APPLICATIONS

This application is a Continuation Application of International Application No. PCT/CN2021/098122, filed on Jun. 3, 2021, which is based upon and claims priority to Chinese Patent Applications No. 202021835266.5, filed on Aug. 28, 2020; No. 202011150807.5, filed on Oct. 24, 2020; No. 202011208676.1, filed on Nov. 3, 2020; No. 202022702038.7, filed on Nov. 20, 2020; No. 202120879149.7, filed on Apr. 27, 2021; No. 202120879167.5, filed on Apr. 27, 2021; the entire contents of which are incorporated herein by reference.

TECHNICAL FIELD

The present invention relates to a foot bath device.

BACKGROUND

Since a basin wall of a traditional foot bath device is made of unfoldable plastic, the size may be excessively large, adverse to packaging, difficult to transport, and awkward to carry. For the above issue, a foldable foot bath device is provided. For example, the granted notice text of Chinese invention patents CN206026180U, CN208740819U, CN211049207U, CN211212829U, CN206924031U, and CN209499552U, as well as the public text of Chinese invention patents CN104287662A, and CN112386144A, all disclose the foldable foot bath device, including an upper frame, a base, and a basin wall connected between the upper frame and the base; a cover plate is arranged on the upper frame; the basin wall is made of flexible material and is foldable; when the basin wall is unfolded to form a foot bath area, the basin wall is supported by a support piece to prevent the collapse of the basin wall; specifically the support piece is arranged on the outside of the basin wall, and the support piece is flipped to form a support for the basin wall after the basin wall is unfolded.

The shortcomings of the prior foldable foot bath device are as follows: 1. The reason why the foldable foot bath device is designed to be foldable is to reduce the size after being folded to facilitate packaging, transporting, and carrying, but the foldable foot bath device in the prior art arranges the support piece on the outside of the basin wall occupying a certain space after folded, which is inconsistent with the original intention to reduce the size of the foldable foot bath device. 2. In the process of folding the foot bath device, it is required to pick up or flip the foot bath device to cause the bottom side to face up before folding the basin wall, and finally the support piece is required to be flipped to the bottom of the folded foot bath device, indicating a troublesome operation. 3. In the process of unfolding the foot bath device, it is required to flip the folded foot bath device to cause the bottom side to face up, and then the support piece and the basin wall are unfolded, indicating a troublesome operation.

SUMMARY

In order to overcome the above shortcomings of the prior foldable foot bath device, the present invention provides a foldable foot bath device with a reduced size after folding and convenient operation.

The technical solutions provided by the present invention for solving the technical problems are as follows. A foldable foot bath device includes a support rod, an upper frame, a base, and a basin wall connected between the upper frame and the base. A cover plate is arranged on the upper frame. The basin wall is made of flexible material and foldable.

When the basin wall is unfolded to form a foot bath area, the basin wall is supported by the support rod to prevent the collapse of the basin wall.

The support rod is located in the space surrounded by the basin wall, and an upper end of the support rod is rotatably connected to the cover plate.

The support rod is supported between the cover plate and the bottom side of the base after the basin wall is unfolded, thereby forming a support for the basin wall.

The support rod is flipped and then approaches the cover plate after the basin wall is folded, to make a space for a folding of the basin wall.

Further, a lower end of the support rod is a free end, and the lower end of the support rod is supported on the bottom side of the base after the basin wall is unfolded. The support rod is flipped around the upper end and then approaches the cover plate after the basin wall is folded.

Further, the support rod is located below the cover plate after the support rod is flipped around the upper end.

Further, the support rod is located above the cover plate after the support rod is flipped around the upper end.

Further, an upper surface of the cover plate is provided with a receiving groove, and the support rod is located in the receiving groove after the support rod is flipped around the upper end.

Further, the support rod includes a plurality of sub-rods, and the sub-rods are rotatably connected to each other end to end.

Further, an embedded groove is arranged on the bottom side of the base. The lower end of the support rod is embedded in the embedded groove after the basin wall is unfolded.

Further, a positioning mechanism is arranged on the cover plate, and the positioning mechanism positions the support rod after the support rod is flipped around the upper end.

Further, the positioning mechanism is a clamping slot arranged on the cover plate, and the support rod is clamped into the clamping slot after flipped around the upper end. Alternatively, the positioning mechanism is a positioning magnet arranged on the cover plate, the support rod is provided with an iron block or a passive magnet, and the iron block or the passive magnet is attracted to the positioning magnet after the support rod is flipped around the upper end.

Further, the support rod is a retractable rod, and the retractable rod is elongated when the basin wall is unfolded. The retractable rod is shortened when the basin wall is folded.

Further, the support rod includes a plurality of sub-rods rotatably connected to each other end to end, and a lower end of the support rod is rotatably connected to the bottom side of the base.

Further, the support rod is longitudinally rotatably connected to the cover plate.

Or, the support rod is laterally rotatably connected to the cover plate.

Further, the support rod is movably connected to an edge of the cover plate.

Further, two support rods are arranged, and the two support rods are movably connected to a left edge and a right edge of the cover plate, respectively.

Further, a flexible grip is detachably arranged on the upper frame, and the grip at least partially covers the outside of the upper frame.

Further, the upper frame is provided with a groove, and the grip is arranged in the groove.

Further, a water spraying channel is arranged in the support rod, and the lower end of the support rod is provided with a water inlet communicated with the water spraying channel. At least one water spraying nozzle communicated with the water spraying channel is arranged on the support rod, and a water spraying mechanism is arranged in the base. The water spraying mechanism is communicated with the water inlet when the support rod is supported on the bottom side of the base.

Advantages of the present invention are as follows. 1. The cover plate of the foot bath device is used as the support point of the upper end of the support rod, and the support rod is arranged in the space surrounded by the basin wall, so that the support rod is located in the space of the folded basin wall after the foot bath device is folded, or the support rod is flipped above the cover plate after the foot bath device is folded, thereby reducing the size of the folded foot bath device. 2. In carrying out a folding operation, the folding can be realized after the support rod is flipped around the upper end, indicating the excellently convenient folding operation. 3. For unfolding the folded foot bath device, it is only required to unfold the basin wall, and then to support the support rod in the basin wall, indicating an excellently convenient unfolding operation.

DETAILED DESCRIPTION OF THE EMBODIMENTS

Figure 1:
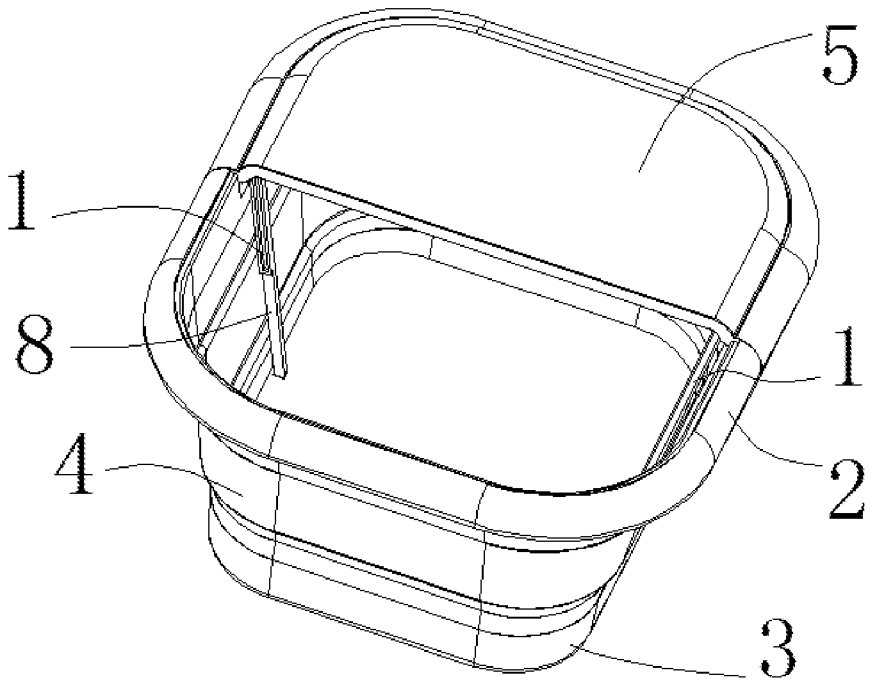
FIG. 1 is a perspective view showing a foot bath device after a basin wall is unfolded according to Embodiment 1.
Figure 2:
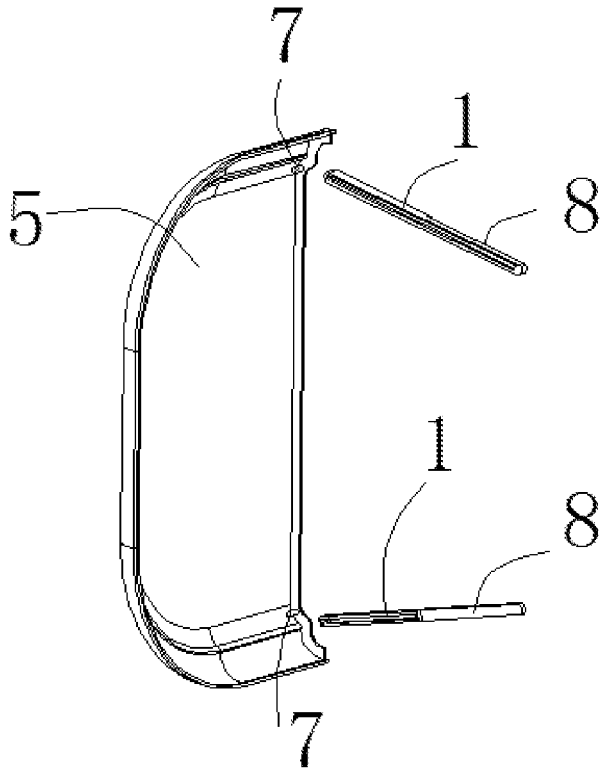
FIG. 2 is an assembling view of a support rod and a cover plate according to Embodiment 1.
Figure 3:
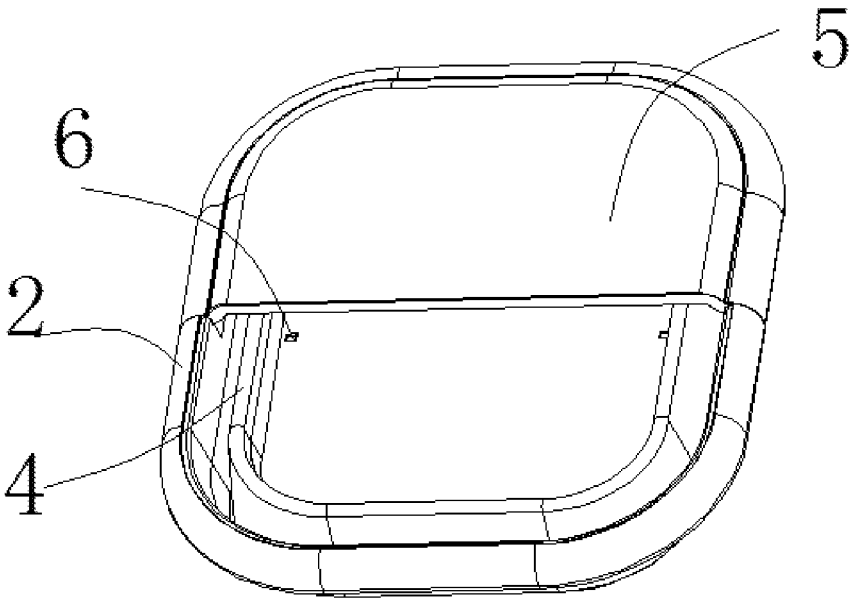
FIG. 3 is a perspective view showing a foot bath device after a basin wall is folded according to Embodiment 1.
Figure 4:
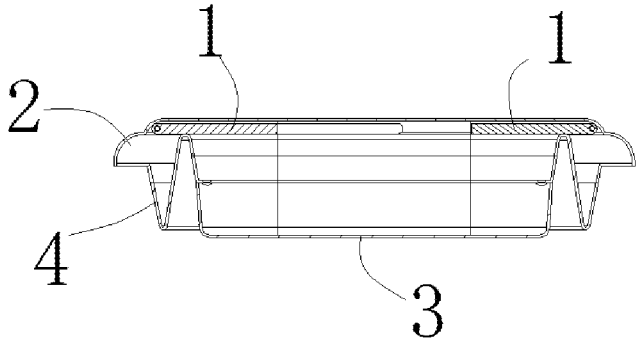
FIG. 4 is a cross-sectional view of the structure in FIG. 3.
Figure 5:
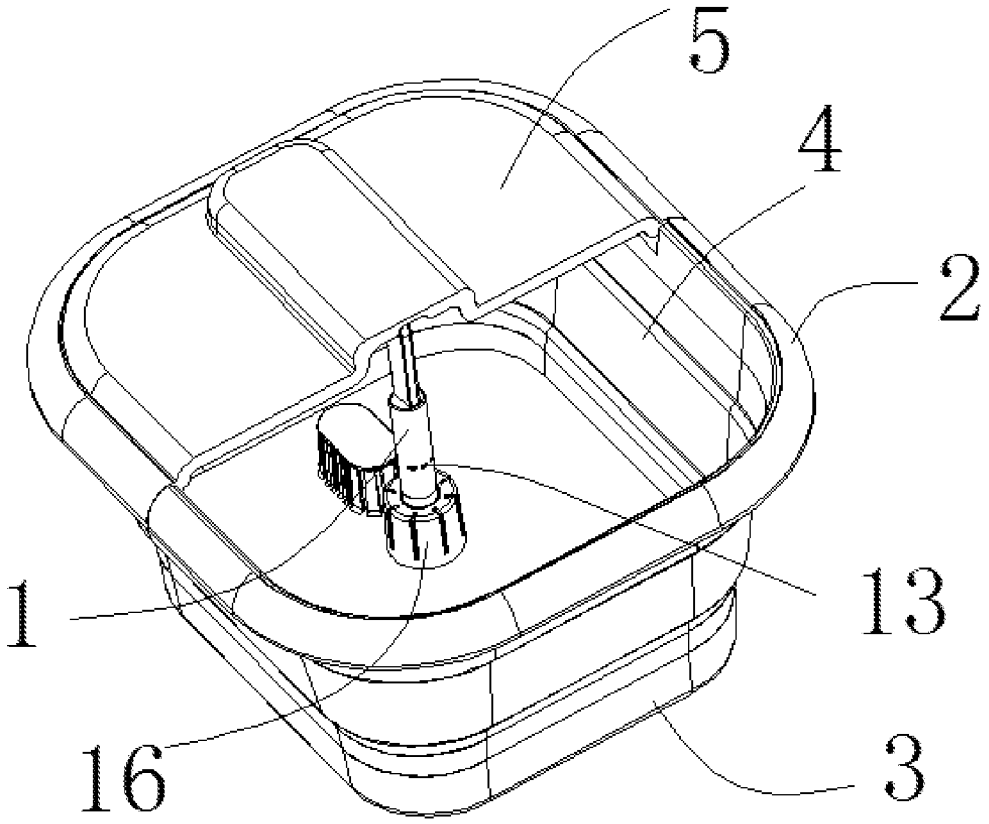
FIG. 5 is a perspective view showing a foot bath device after a basin wall is unfolded according to Embodiment 2.
Figure 6:
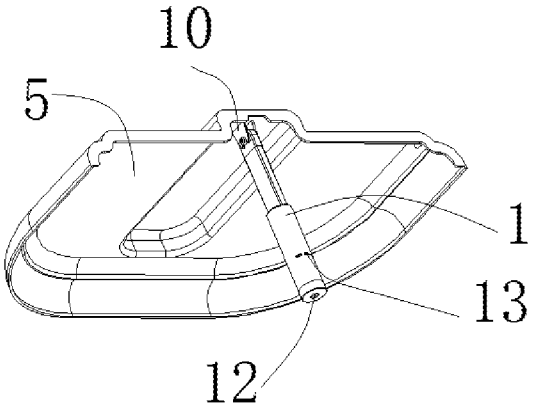
FIG. 6 is an assembling view of a support rod and a cover plate according to Embodiment 2.
Figure 7:
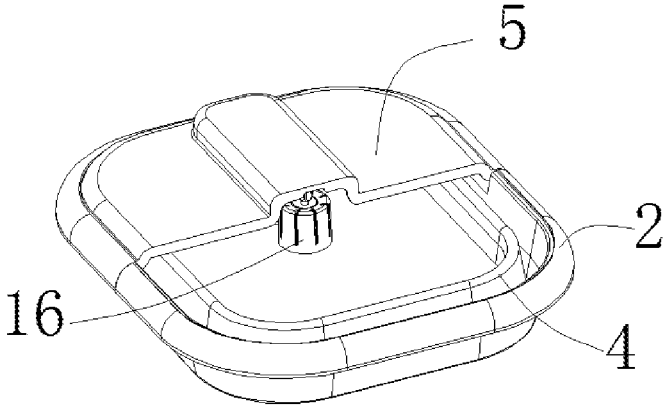
FIG. 7 is a perspective view showing a foot bath device after a basin wall is folded according to Embodiment 2.
Figure 8:
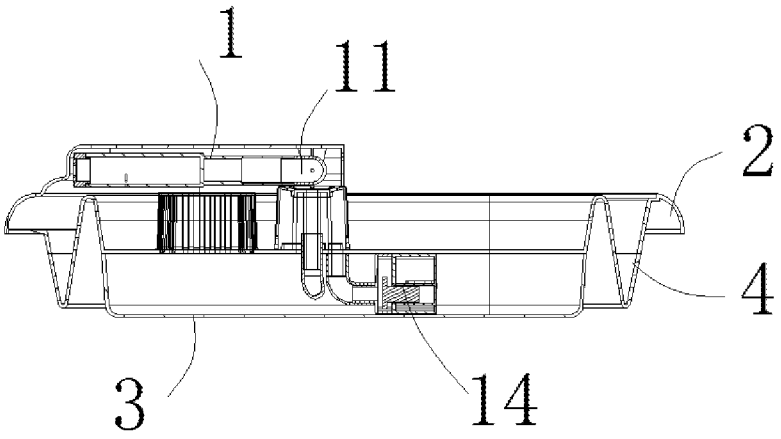
FIG. 8 is a cross-sectional view of the structure in FIG. 7.

The present invention is further described in detail below with reference to the drawings and specific embodiments.

In Embodiment 1, referring to FIGS. 1 to 4, a foldable foot bath device includes the support rod 1, the upper frame 2, the base 3, and the basin wall 4 connected between the upper frame 2 and the base 3. The cover plate 5 is arranged on the upper frame 2. The foldable basin wall 4 is made of flexible material.

When the basin wall 4 is unfolded to form a foot bath area, the basin wall 4 is supported by the support rod 1 to prevent the collapse of the basin wall 4.

The support rod 1 is located in the space surrounded by the basin wall 4, and the upper end of the support rod 1 is rotatably connected to the cover plate 5.

The support rod 1 is supported between the cover plate 5 and the bottom side of the base 3 after the basin wall 4 is unfolded, thereby forming a support for the basin wall 4. The lower end of the support rod 1 is a free end, and the lower end of the support rod 1 is supported on the bottom side of the base 3 after the basin wall 4 is unfolded. The embedded groove 6 may be arranged on the bottom side of the base 3, and the lower end of the support rod 1 is embedded in the embedded groove 6 after the basin wall 4 is unfolded, so that the support is more stable.

The support rod 1 is flipped and then approaches the cover plate 5 after the basin wall 4 is folded, to make a space for the folding of the basin wall 4. The support rod 1 is flipped around the upper end of the support rod 1 and then approaches the cover plate 5, and the support rod 1 is located below the cover plate 5. In this case, the support rod 1 is located in the space between the cover plate 5 and the bottom side of the base 3.

In the present embodiment, the support rod 1 is laterally rotatably connected to the cover plate 5, and a mode of a rotatable connection is usually as follows: the rotating shaft 7 is arranged on the cover plate 5, and the support rod 1 is arranged on the rotating shaft 7 in a penetrating manner; alternatively, a rotating shaft is arranged on the support rod, and the rotating shaft is inserted into the cover plate. The indicated "laterally rotatably connected" means that the support rod 1 is flipped around the upper end of the support rod 1 after the basin wall is folded, which means the lateral rotation, and the rotated support rod 1 lies laterally in the space between the cover plate 5 and the bottom side of the base 3.

The support rod 1 is configured as a retractable rod when the support rod 1 is laterally rotatably connected to the cover plate 5 and is movably connected to the middle part of the cover plate 5 in a transverse direction. The retractable rod is elongated when the basin wall 4 is unfolded, and the retractable rod is shortened when the basin wall 4 is folded. The form of the retractable rod may be arranged as follows: the retractable rod is composed of a plurality of sub-rods in a sleeve connection. The sub-rods of the retractable rod are stretched out when the retractable rod is elongated, and the sub-rods are nested layer by layer after the retractable rod is shortened and compressed. It will not be detailed here since this type of the retractable rod is conventional techniques. Alternatively, the support rod 1 may be arranged as follows: the support rod 1 includes a plurality of sub-rods rotatably connected to each other end to end, and in this case, the lower end of the support rod 1 may also be rotatably connected to the bottom side of the base (certainly, it may only be supported on the bottom side of the base instead of being rotatably connected). Each of the sub-rods is unfolded when the basin wall 4 is unfolded, and all or a part of the sub-rods are folded when the basin wall is folded. When the support rod 1 is movably connected to the middle part of the cover plate in the transverse direction, since the support rod 1 cannot be accommodated in the basin wall 4 due to the excessive length after the support rod 1 is rotated laterally, the support rod 1 is required to be shortened or folded, and the support rod must adopt a retractable rod or be composed of the sub-rods rotatably connected to each other end to end.

Preferably, the support rod 1 is movably connected to the edge of the cover plate 5 when the support rod 1 is laterally rotatably connected to the cover plate 5, so that the support rod 1 is not required to adopt the modes of the retractable rod or the folded sub-rods. The number of the support rods 1 is preferably two, and two support rods 1 are movably connected to the left edge and the right edge of the cover plate 5, respectively, so as to enable the support effect of the support rod 1 to be more stable. The lower part of each of the two support rods 1 are preferably provided with the concave avoiding part 8 when two support rods 1 are arranged. Thus, the lower ends of the two support rods 1 are respectively placed in the corresponding avoiding parts 8 after the basin wall 4 is folded and the support rod 1 is flipped.

In Embodiment 2, referring to FIGS. 5-11, a foldable foot bath device includes the support rod 1, the upper frame 2, the base 3, and the basin wall 4 connected between the upper frame 2 and the base 3. The cover plate 5 is arranged on the upper frame 2. The foldable basin wall 4 is made of flexible material.

When the basin wall 4 is unfolded to form a foot bath area, the basin wall 4 is supported by the support rod 1 to prevent the collapse of the basin wall 4.

The support rod 1 is located in the space surrounded by the basin wall 4, and the upper end of the support rod 1 is rotatably connected to the cover plate 5.

The support rod 1 is supported between the cover plate 5 and the bottom side of the base 3 after the basin wall 4 is unfolded, thereby forming a support for the basin wall 4. In the present embodiment, the lower end of the support rod 1 is a free end, and the lower end of the support rod 1 is supported on the bottom side of the base 3 after the basin wall 4 is unfolded. The support seat 9 may be arranged on the bottom side of the base 3, and the lower end of the support rod 1 is supported on the support seat 9. Certainly, the bottom side of the base may not be provided with the support seat, and the lower end of the support rod may be directly supported on the bottom side of the base.

Figure 9:
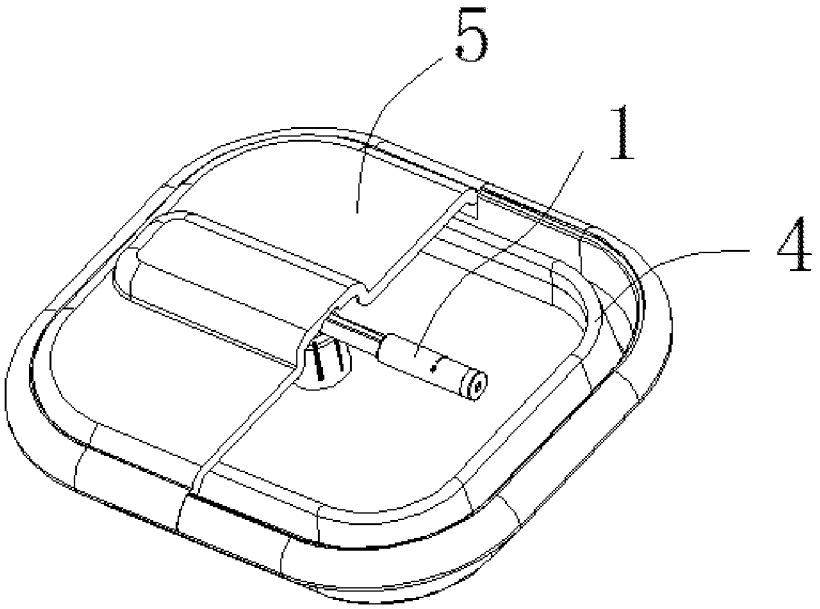
FIG. 9 is a perspective view showing another state of a foot bath device after a basin wall is folded according to Embodiment 2.
Figure 10:
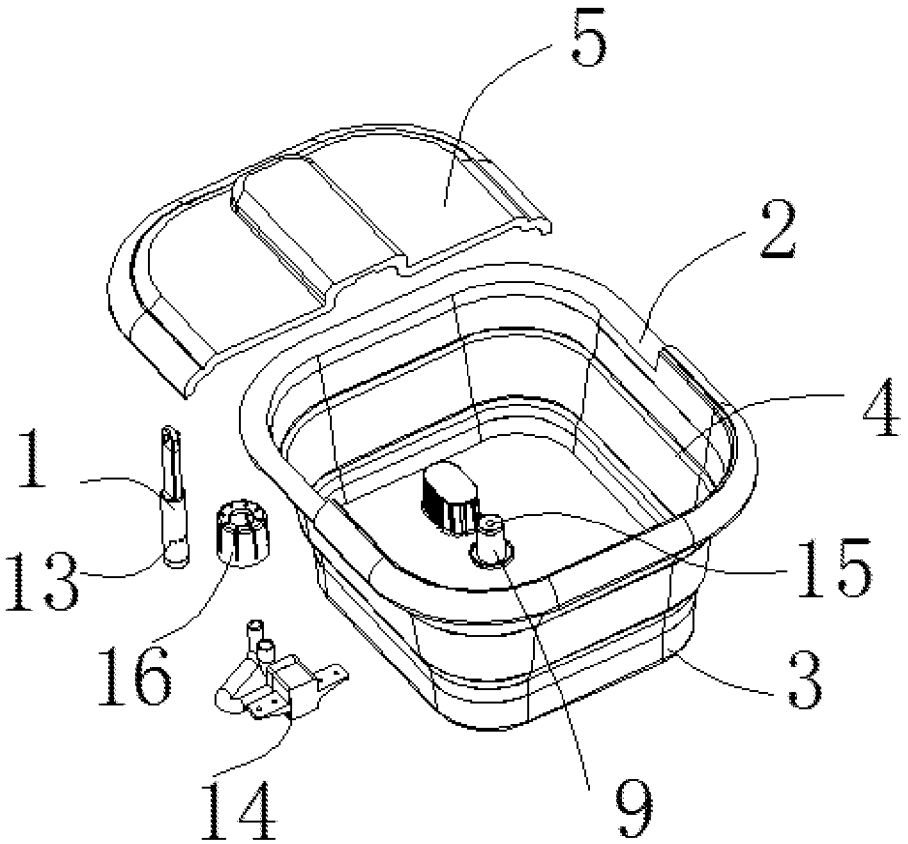
FIG. 10 is an exploded view showing a foot bath device according to Embodiment 2.
Figure 11:
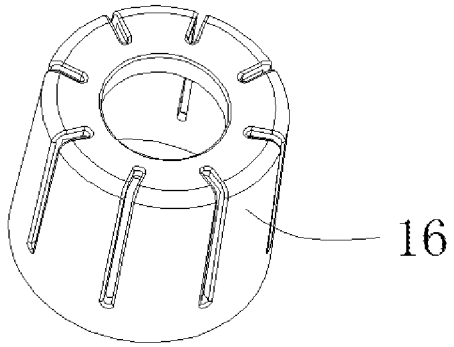
FIG. 11 is a schematic view showing the structure of a support seat according to Embodiment 2.
Figure 12:
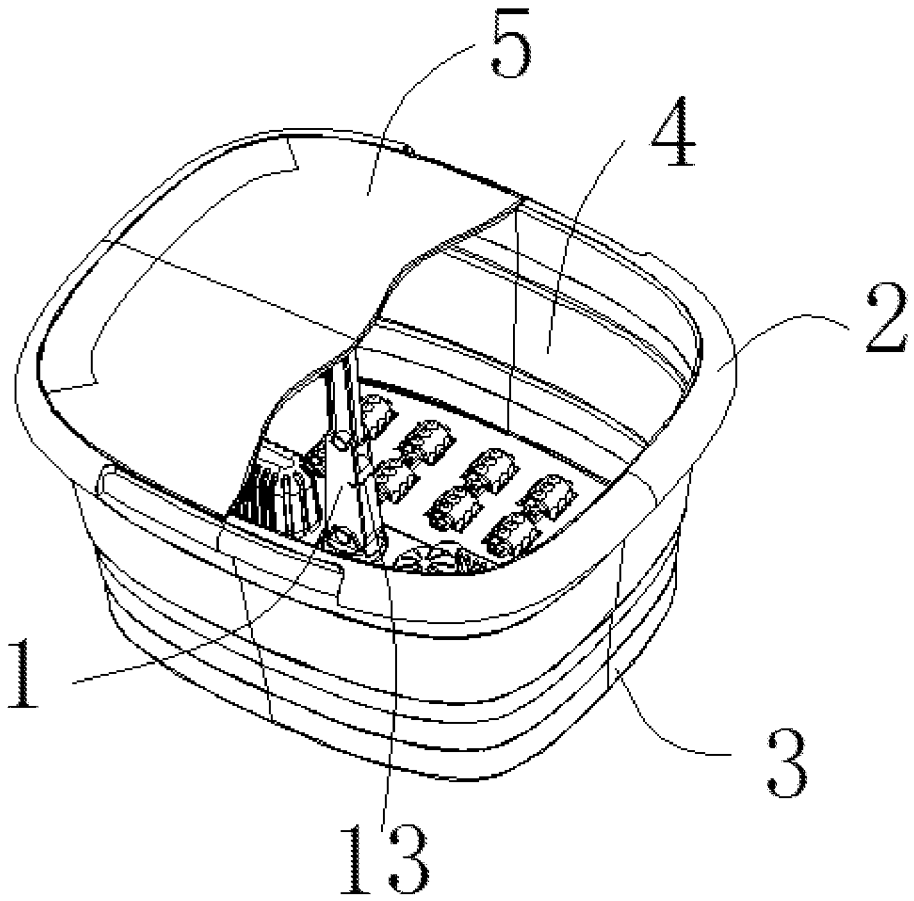
FIG. 12 is a perspective view showing a foot bath device after a basin wall is unfolded according to Embodiment 3.
Figure 13:
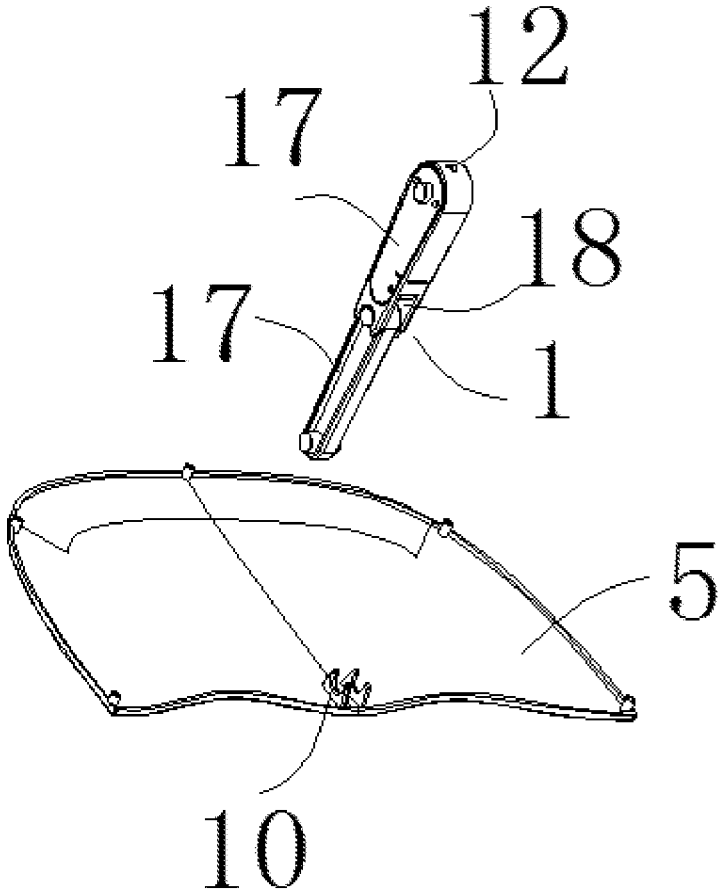
FIG. 13 is an assembling view of a support rod and a cover plate according to Embodiment 3.
Figure 14:
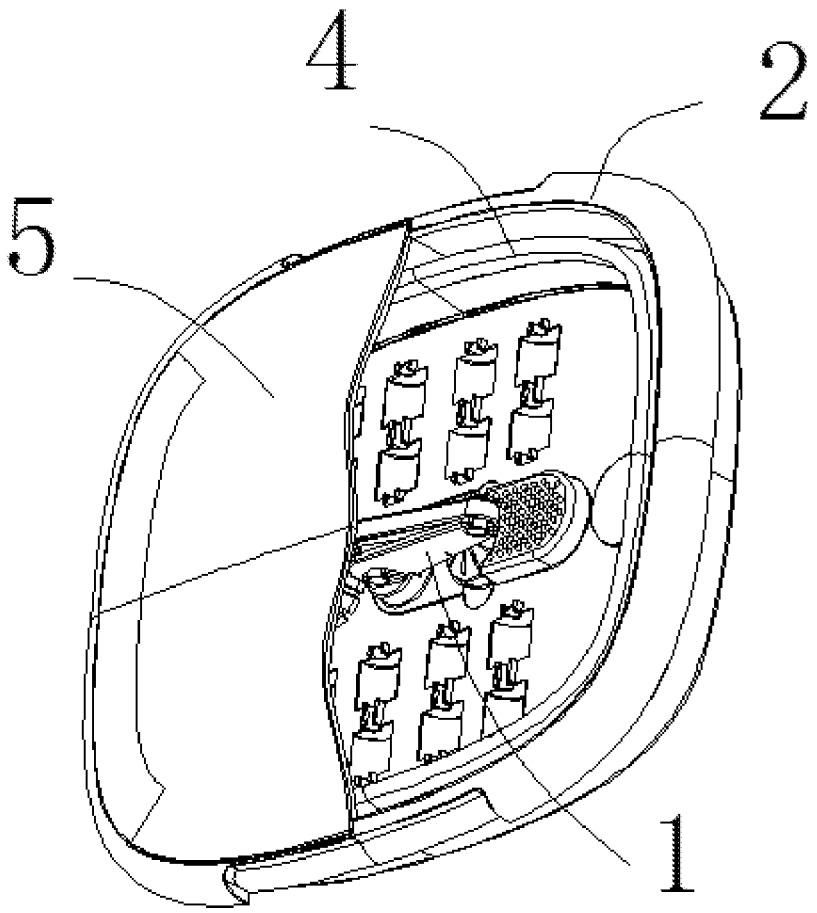
FIG. 14 is a perspective view showing a foot bath device after a basin wall is folded according to Embodiment 3.
Figure 15:
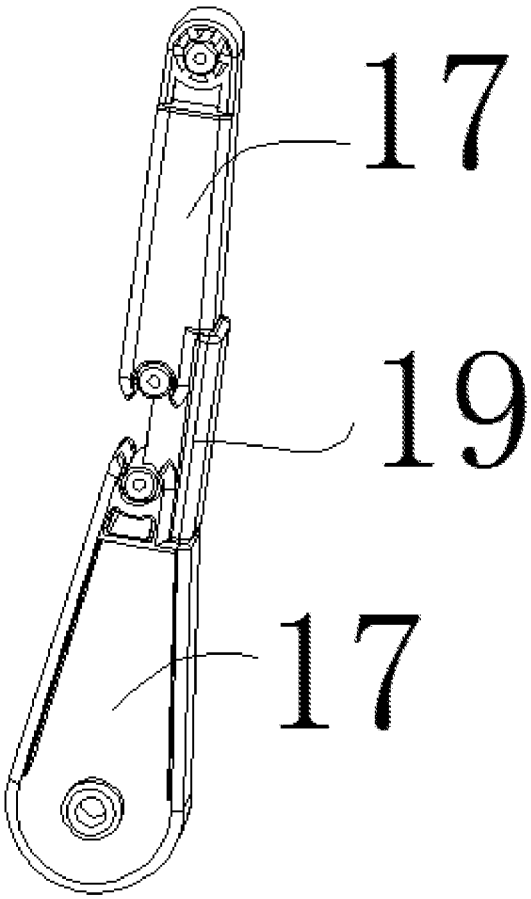
FIG. 15 is a schematic view showing the structure of a support rod having another structural form according to Embodiment 3.
Figure 16:
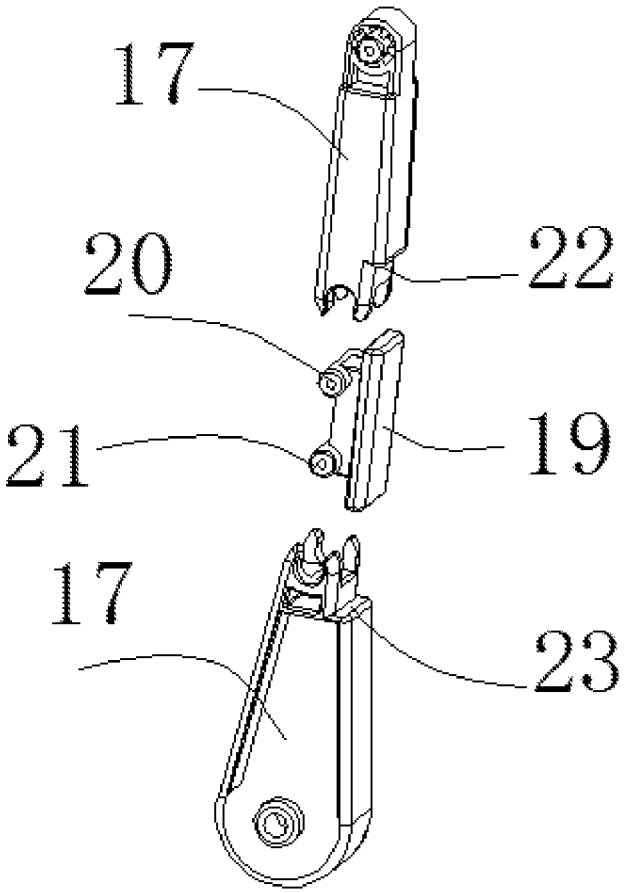
FIG. 16 is an exploded view of a support rod in FIG. 15.
Figure 17:
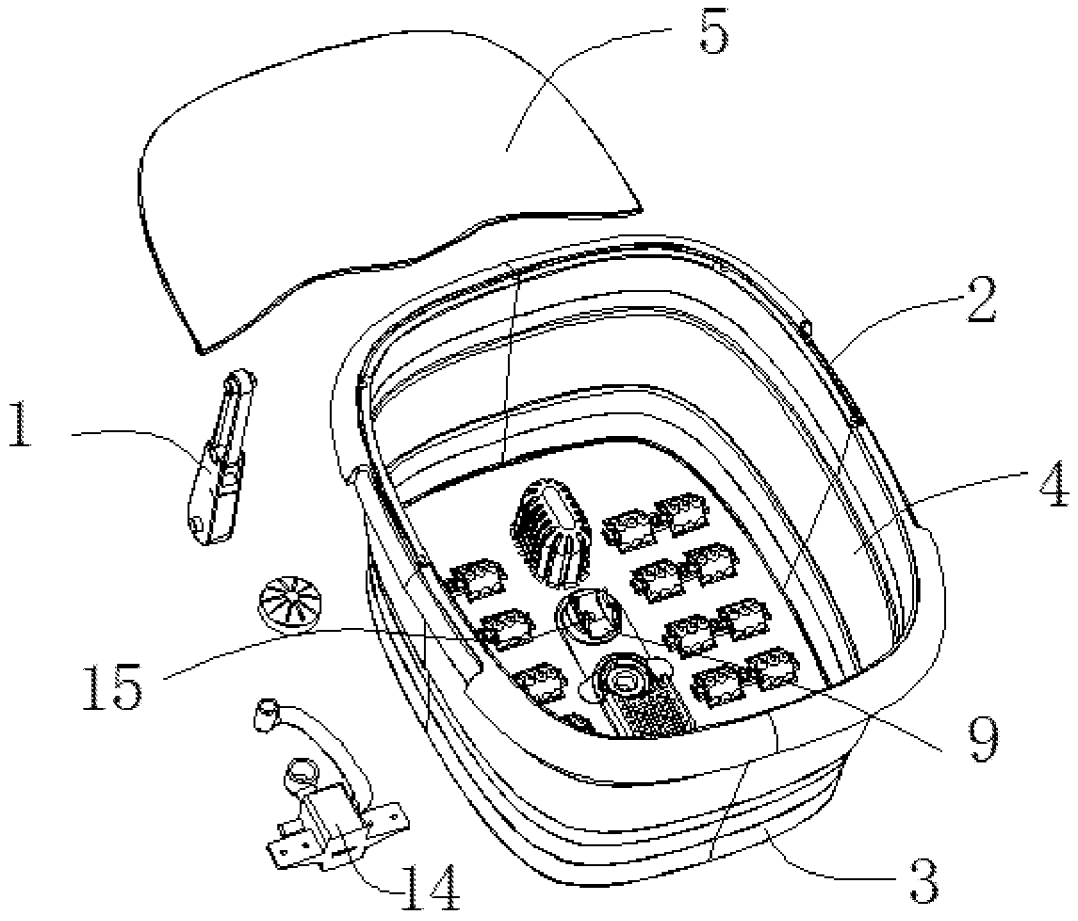
FIG. 17 is an exploded view of a foot bath device according to Embodiment 3.
Figure 18:
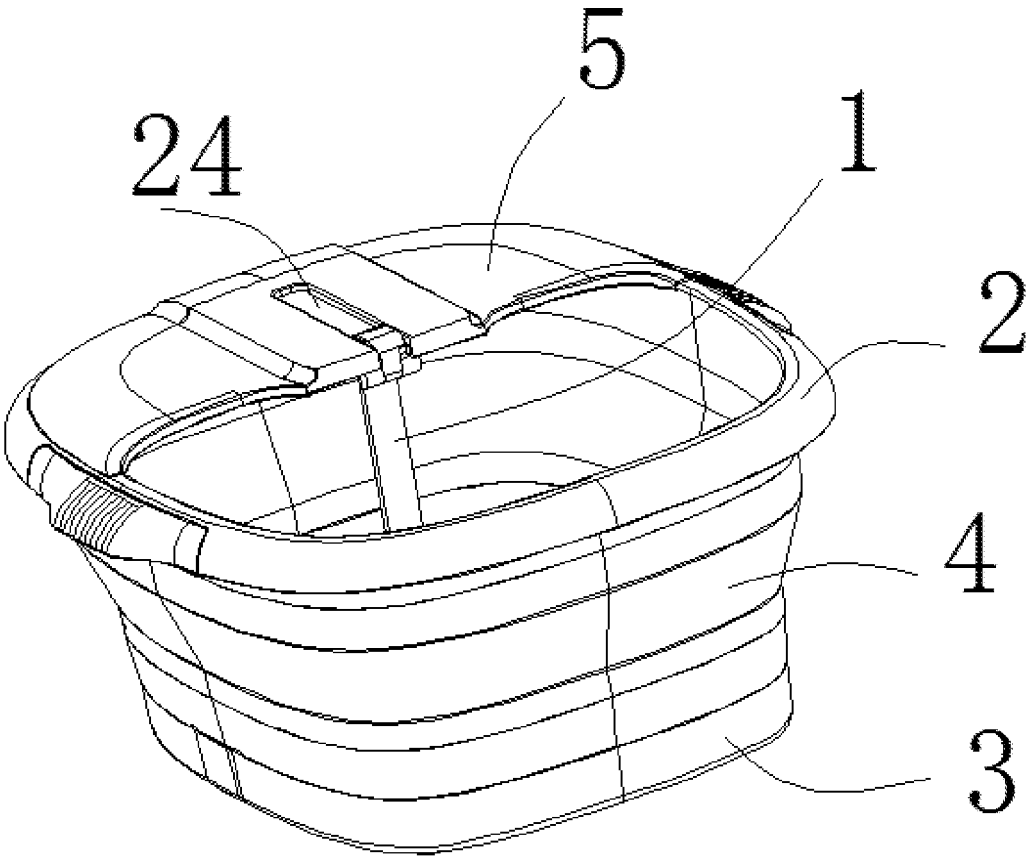
FIG. 18 is a perspective view showing a foot bath device after a basin wall is unfolded according to Embodiment 4.
Figure 19:
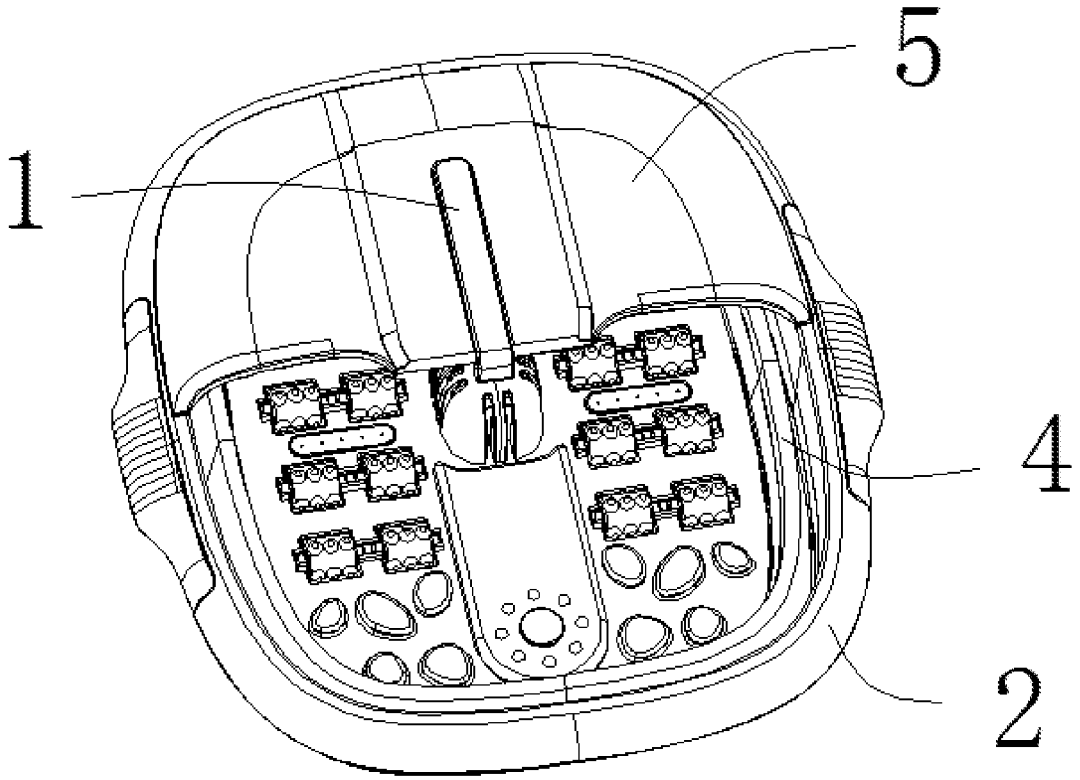
FIG. 19 is a perspective view showing a foot bath device after a basin wall is folded according to Embodiment 4.
Figure 20:
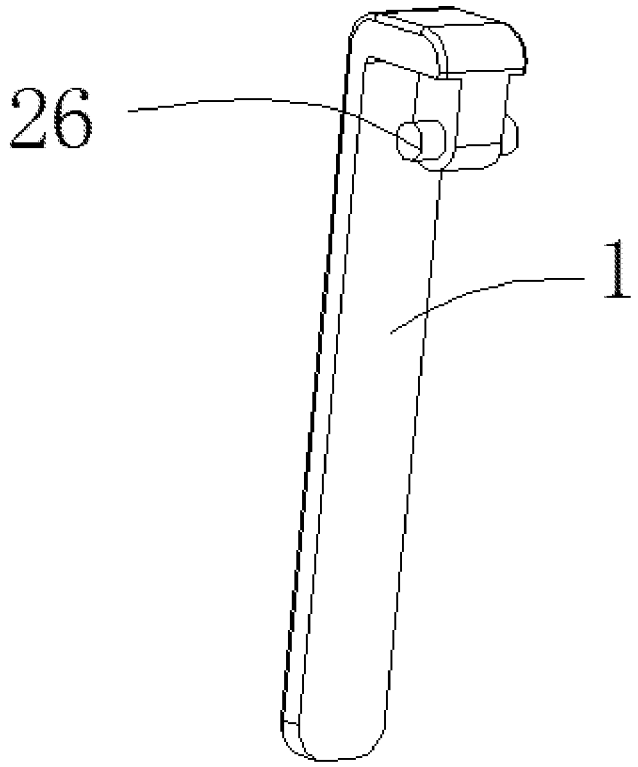
FIG. 20 is a schematic view showing the structure of a support rod according to Embodiment 4.
Figure 21:
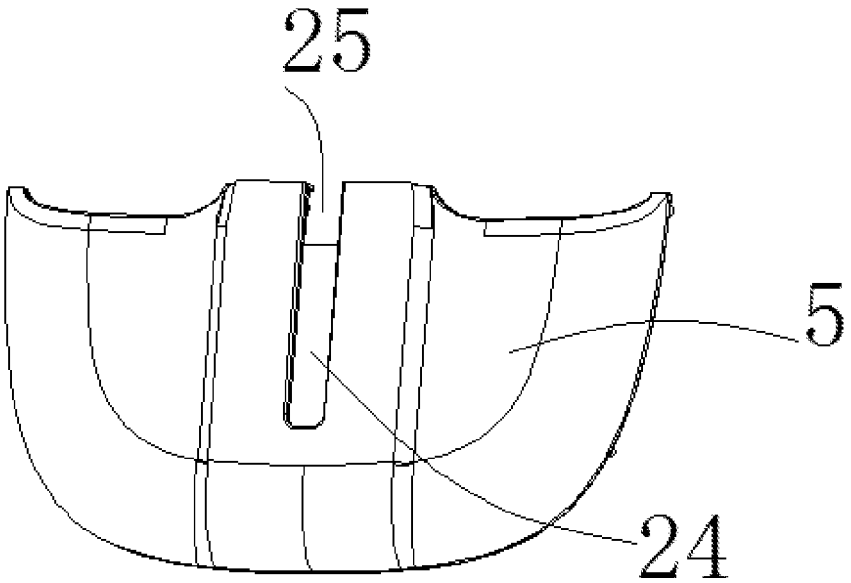
FIG. 21 is a schematic view showing the structure of a cover plate according to Embodiment 4.

The support rod 1 is flipped around the upper end of the support rod 1 and then approaches the cover plate 5 after the basin wall 4 is folded, to make a space for the folding of the basin wall 4. In the present embodiment, after the support rod 1 is flipped around the upper end of the support rod 1, the support rod 1 is located below the cover plate 5, i.e., in the space between the cover plate 5 and the base 3. Certainly, as shown in FIG. 9, after the support rod 1 is flipped around the upper end of the support rod 1, the support rod 1 is not completely located directly below the cover plate 5, but in the space outside the cover plate 5; but in terms of orientations and positions, the support rod 1 is still located below the cover plate 5, that is, the support rod 1 is located in the space of the folded basin wall 4, so as to still play a role of saving space.

In the present embodiment, the support rod 1 is longitudinally rotatably connected to the cover plate 5, that is, the support rod 1 is flipped around the upper end of the support rod 1, which means the longitudinal rotation, and the support rod 1 lies longitudinally between the cover plate 5 and the base 3 after rotated. The mode of the rotatable connection between the support rod 1 and the cover plate 5 may be achieved as follows: the hinge seat 10 is arranged on the cover plate 5, and the upper end of the support rod 1 is hinged on the hinge seat 10; alternatively, a rotating shaft is arranged directly on the cover plate, and the upper end of the support rod is arranged on the rotating shaft in a penetrating manner; alternatively, a rotating shaft is arranged on the upper end of the support rod, and the rotating shaft is arranged on the cover plate in a penetrating manner, or the like.

The support rod 1 may also be a retractable rod. The retractable rod is elongated when the basin wall 4 is unfolded, and the retractable rod is shortened when the basin wall 4 is folded. The form of the retractable rod may be arranged as follows: the retractable rod is composed of a plurality of sub-rods in a sleeve connection. The sub-rods of the retractable rod are stretched out when the retractable rod is elongated, and the sub-rods are nested layer by layer after the retractable rod is shortened and compressed. It will not be detailed here since this type of the retractable rod is conventional techniques. The advantages of using the retractable rod is as follows: since the length of the support rod increases as the distance between the cover plate and the base increases when the basin wall is unfolded, the support length may be excessively long, and the support rod is beyond the range of the basin wall when the support rod is flipped around the upper end of the support rod 1, resulting in that the support rod cannot be accommodated in the folded basin wall, thereby requiring the support rod to be shortened when the basin wall is folded.

The water spraying channel 11 may also be arranged in the support rod 1, and the lower end of the support rod 1 is provided with the water inlet 12 communicated with the water spraying channel 11. At least one water spraying nozzle 13 communicated with the water spraying channel 11 is arranged on the support rod 1, and the water spraying mechanism 14 is arranged in the base 3. The water spraying mechanism 14 is communicated with the water inlet 12 when the support rod 1 is supported on the bottom side of the base 3, so that water is delivered to the water spraying channel 11 by the water spraying mechanism 14 through the water inlet 12 and eventually sprayed from the water spraying nozzle 13. The typical mechanism form of the water spraying mechanism 14 is a water pump, which pumps the water from the foot bath device into the water spraying channel 11.

In case that the support seat 9 is arranged on the bottom side of the base, the water passing channel 15 may be formed in the support seat 9. When the support rod 1 is supported on the support base 9, the water inlet 12 at the lower end of the support rod 1 is communicated with the water passing channel 15 in the support seat 9, and the water passing channel 15 in the support seat 9 is communicated with the water outlet of the water pump. The water is first pumped by the water pump to the water passing channel 15, and then enters the water spraying channel 11. The protective casing 16 may also be installed on the support seat 9, and the protective casing 16 is provided with a gap. In this way, the water inlet of the water pump can be set in the protective casing, and when the water enters through the gap of the protective casing 16, a relatively large area of water absorbing effect can be produced. Meanwhile, in cooperation with the water spraying of the water spraying nozzle 13, water bloom or water turbulence will be largely produced in the foot bath device.

In Embodiment 3, referring to FIGS. 12-17, a foldable foot bath device includes the support rod 1, the upper frame 2, the base 3, and the basin wall 4 connected between the upper frame 2 and the base 3. The cover plate 5 is arranged on the upper frame 2. The foldable basin wall 4 is made of flexible material.

When the basin wall 4 is unfolded to form a foot bath area, the basin wall 4 is supported by the support rod 1 to prevent the collapse of the basin wall 4.

The support rod 1 is located in the space surrounded by the basin wall 4, and the upper end of the support rod 1 is rotatably connected to the cover plate 5.

The support rod 1 is supported between the cover plate 5 and the bottom side of the base 3 after the basin wall 4 is unfolded, thereby forming a support for the basin wall 4. In the present embodiment, the support rod 1 includes a plurality of the sub-rods 17 rotatably connected to each other end to end (the number of the sub-rods 17 is two in the present embodiment, certainly, a larger number of the sub-rods may be adopted), and the lower end of the support rod 1 is rotatably connected to the bottom side of the base 3. The support seat 9 may be arranged on the bottom side of the base 3, and the lower end of the support rod 1 is rotatably connected to the support seat 9. Certainly, the bottom side of the base 3 may not be provided with the support seat, and the lower end of the support rod is directly rotatably connected to the bottom side of the base. The rotatable connection between the sub-rods 17 of the support rod 1 may be achieved by only using a rotating shaft. In order to facilitate the folding between the sub-rods, the rotatable connection between the sub-rods 17 of the support rod 1 may be also achieved as follows: the lower end of the upper sub-rod is provided with the inner groove 18, the upper end of the lower sub-rod is located in the inner groove 18, and the upper end of the lower sub-rod and the inner groove are rotatably connected to each other by a rotating pin. Alternatively, the rotatable connection between the sub-rods 17 of the support rod 1 may be achieved as follows: the upper sub-rod and the lower sub-rod may be rotatably connected by a connecting piece. The specific structure mode may be as follows: the connecting piece is the connecting plate 19, and the connecting plate 19 is provided with the upper hinge shaft 20 and the lower hinge shaft 21; the lower end of the upper sub-rod is hinged on the upper hinge shaft 20, and the upper end of the lower sub-rod is hinged on the lower hinge shaft 21. Preferably, the upper sub-rod has the upper convex shoulder 22, and the lower sub-rod has the lower convex shoulder 23. After each of the sub-rods 17 is unfolded, the upper convex shoulder 22 abuts against the upper end surface of the connecting plate 19, and the lower convex shoulder 23 abuts against the lower end surface of the connecting plate 19, so as to achieve the positioning of the sub-rods.

The support rod 1 is flipped around the upper end of the support rod 1 and then approaches the cover plate 5 after the basin wall 4 is folded, and each of the sub-rods 17 of the support rod is also folded simultaneously, to make a space for the folding of the basin wall 4. In the present embodiment, after the support rod 1 is flipped around the upper end of the support rod 1 and each of the sub-rods 17 is folded, the support rod 1 is located below the cover plate 5, i.e., in the space between the cover plate 5 and the base 3. In case that the support rod 1 adopts the form of a plurality of the sub-rods 17 rotatably connected to each other end to end, when the lower end of the support rod is rotatably connected to the bottom side of the base 3, the sub-rods 17 of the support rod 1 can be folded or unfolded accordingly only by folding or unfolding the basin wall 4 without requiring to manually flip the support rod 1 when the basin wall 4 is folded and unfolded.

In the present embodiment, the support rod 1 is longitudinally rotatably connected to the cover plate 5, that is, the support rod 1 is flipped around the upper end of the support rod 1, which means the longitudinal rotation, and the support rod 1 lies longitudinally between the cover plate 5 and the base 3 after flipped. The mode of the rotatable connection between the support rod 1 and the cover plate 5 may be achieved as follows: the hinge seat 10 is arranged on the cover plate 5, and the upper end of the support rod 1 is hinged on the hinge seat 10; alternatively, a rotating shaft is arranged directly on the cover plate, and the upper end of the support rod is arranged on the rotating shaft in a penetrating manner; alternatively, a rotating shaft is arranged on the upper end of the support rod, and the rotating shaft is arranged on the cover plate in a penetrating manner, or the like.

The water spraying channel may also be arranged in the support rod 1, and the lower end of the support rod 1 is provided with the water inlet 12 communicated with the water spraying channel. At least one water spraying nozzle 13 communicated with the water spraying channel is arranged on the support rod 1, and the water spraying mechanism 14 is arranged in the base 3. The water spraying mechanism 14 is communicated with the water inlet 12 when the support rod 1 is supported on the bottom side of the base 3, so that water is delivered to the water spraying channel by the water spraying mechanism 14 through the water inlet 12 and eventually sprayed from the water spraying nozzle 13. The typical mechanism form of the water spraying mechanism 14 is a water pump, which pumps the water from the foot bath device into the water spraying channel.

In case that the support seat 9 is arranged on the bottom side of the base, the water passing channel 15 may be formed in the support seat 9. The water inlet 12 at the lower end of the support rod is communicated with the water passing channel 15 in the support seat, and the water passing channel 15 in the support seat is communicated with the water outlet of the water pump. The water in the foot bath device is pumped by the water pump to the water passing channel 15, and then enters the water spraying channel.

In Embodiment 4, referring to FIGS. 18-21, a foldable foot bath device includes the support rod 1, the upper frame 2, the base 3, and the basin wall 4 connected between the upper frame 2 and the base 3. The cover plate 5 is arranged on the upper frame 2. The foldable basin wall 4 is made of flexible material.

When the basin wall 4 is unfolded to form a foot bath area, the basin wall 4 is supported by the support rod 1 to prevent the collapse of the basin wall 4.

The support rod 1 is located in the space surrounded by the basin wall 4, and the upper end of the support rod 1 is rotatably connected to the cover plate 5.

The support rod 1 is supported between the cover plate 5 and the bottom side of the base 3 after the basin wall 4 is unfolded, thereby forming a support for the basin wall 4. The lower end of the support rod 1 is a free end, and the lower end of the support rod 1 is supported on the bottom side of the base 3 after the basin wall 4 is unfolded.

The support rod 1 is flipped around the upper end of the support rod 1 and then approaches the cover plate 5 after the basin wall 4 is folded, to make a space for the folding of the basin wall 4. In the present embodiment, the support rod 1 is located above the cover plate 5 after the support rod 1 is flipped around the upper end of the support rod 1. In order to further reduce the product size after the support rod 1 is flipped, the upper surface of the cover plate 5 is provided with the receiving groove 24, and the support rod 1 is located in the receiving groove 24 after the support rod 1 is flipped around the upper end of the support rod 1.

In the present embodiment, the support rod 1 is longitudinally rotatably connected to the cover plate 5, that is, the support rod 1 is flipped around the upper end of the support rod 1, which means the longitudinal rotation after the basin wall 4 is folded, and the support rod 1 lies longitudinally above the cover plate 5 after flipped. In order to enable the support rod 1 to be successfully flipped above the cover plate 5, the support rod may be rotatably connected to the edge of the cover plate by a hinge. Alternatively, the edge of the cover plate 5 may be provided with the notch 25, and the upper end of the support rod 1 is located in the notch 25 and connected to the edge of the notch by the rotating pin 26.

Figure 22:
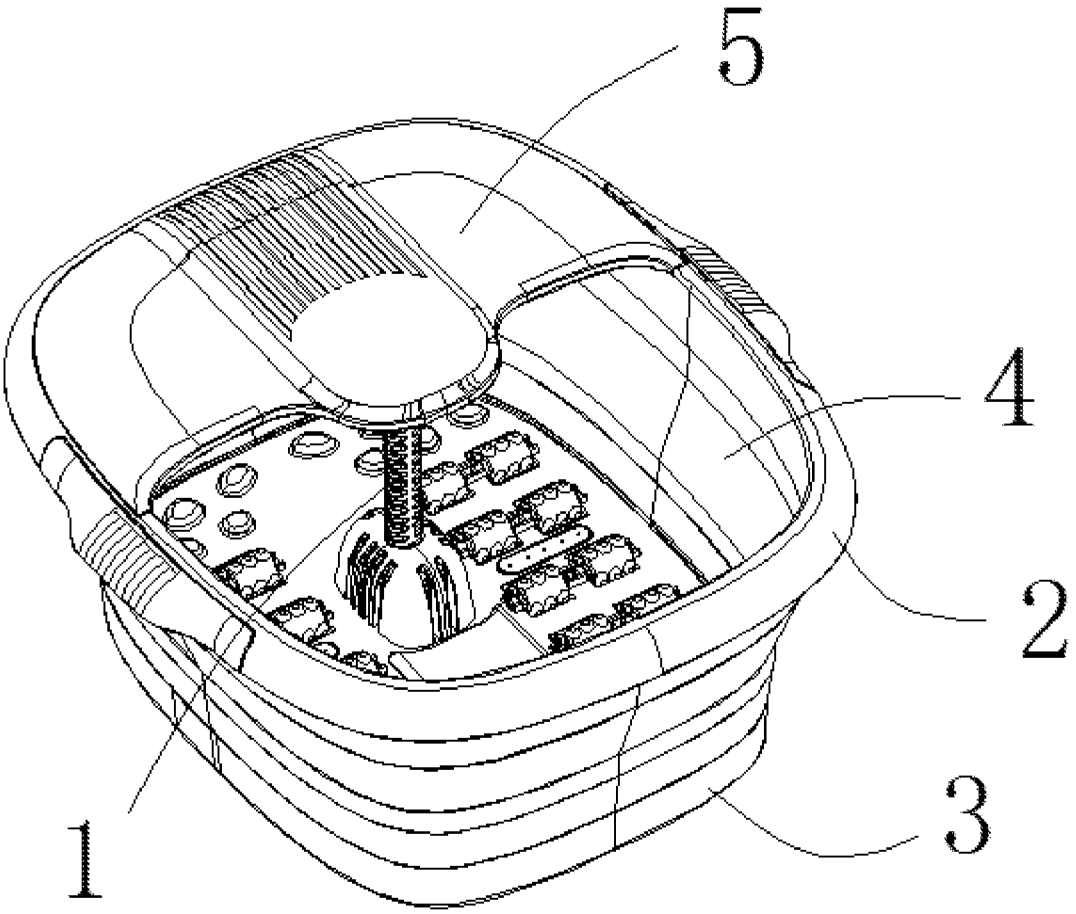
FIG. 22 is a perspective view showing a foot bath device after a basin wall is unfolded according to Embodiment 5.
Figure 23:
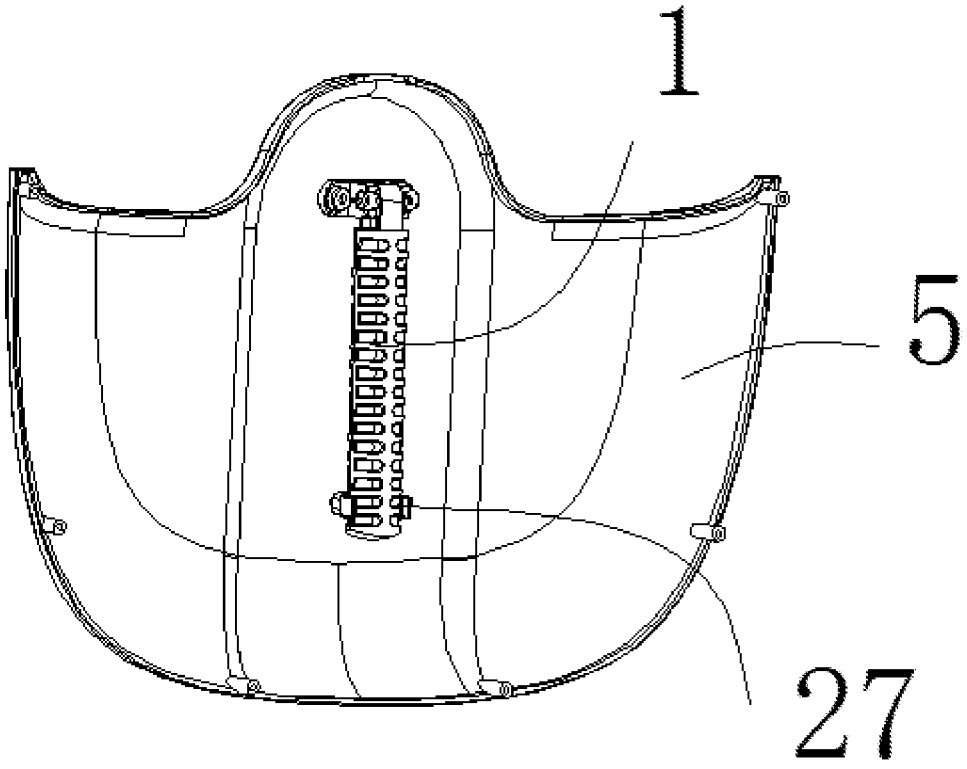
FIG. 23 is a schematic view showing the cooperation between a flipped support rod and a cover plate according to Embodiment 5.
Figure 24:
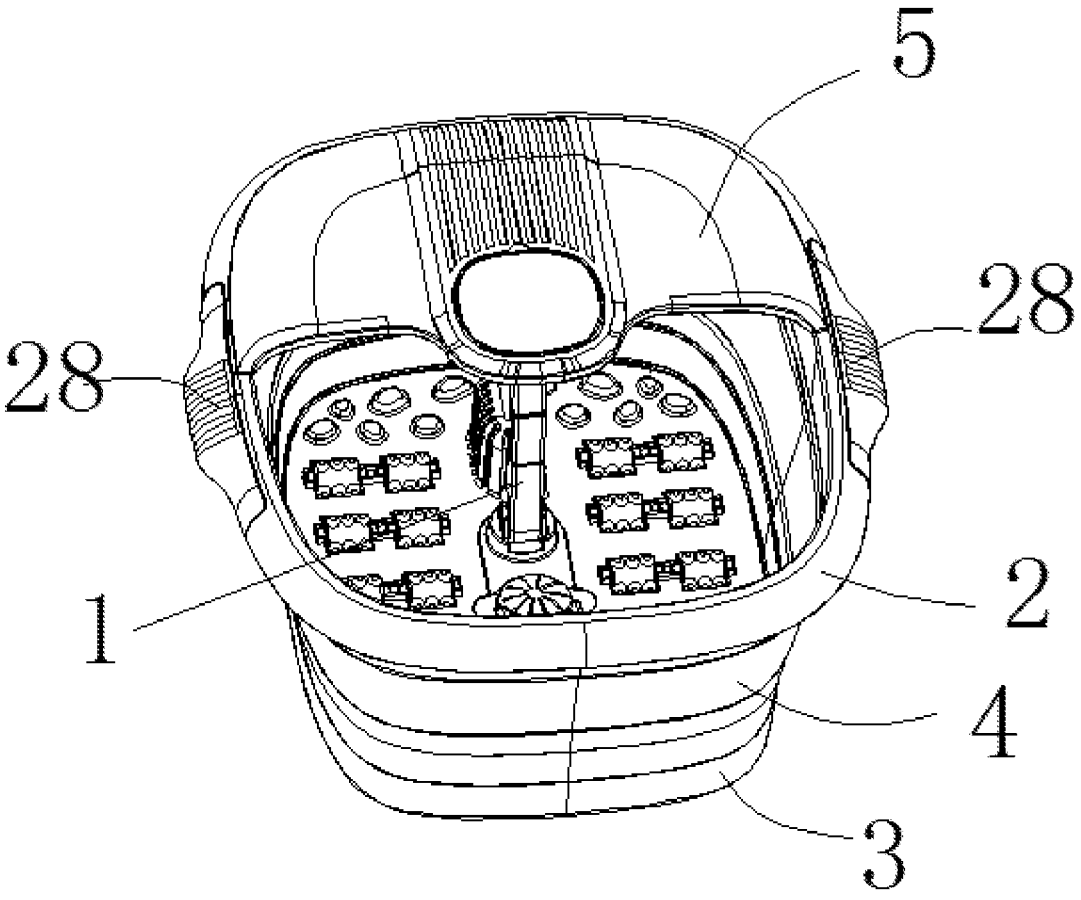
FIG. 24 is a perspective view showing a foot bath device after a basin wall is unfolded according to Embodiment 6.
Figure 25:
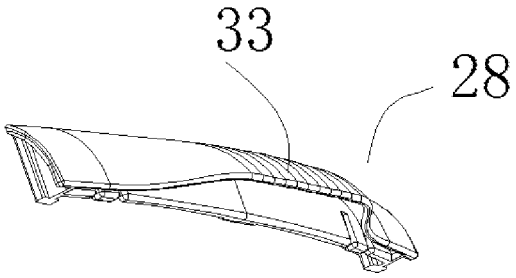
FIG. 25 is a schematic view showing a front structure of a grip according to Embodiment 6.
Figure 26:
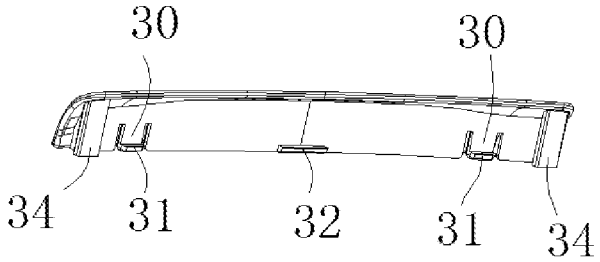
FIG. 26 is a schematic view showing a back structure of a grip according to Embodiment 6.
Figure 27:
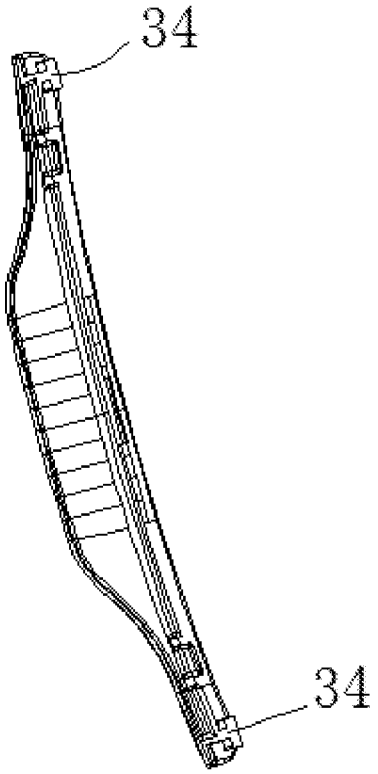
FIG. 27 is a top view of a grip according to Embodiment 6.
Figure 28:
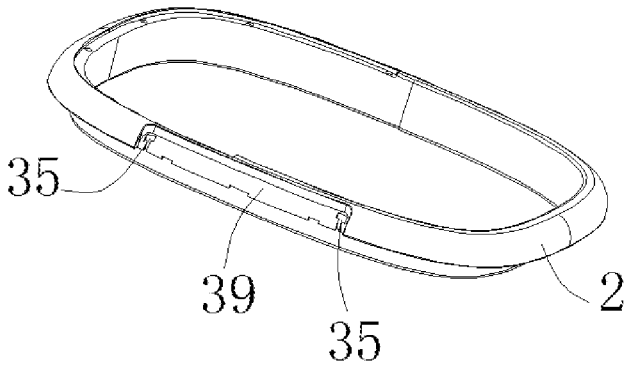
FIG. 28 is a schematic view of an upper frame in Embodiment 6.

In Embodiment 5, referring to FIGS. 22-23, in the present embodiment, the positioning mechanism on the cover plate 5 positions the support rod 1 after the support rod 1 is flipped around the upper end of the support rod 1, to prevent the support rod 1 from shaking in the folded basin wall 4. The positioning mechanism may be arranged as the clamping slot 27 arranged on the cover plate 5, and the support rod 1 is clamped into the clamping slot 27 after flipped around the upper end of the support rod 1.

Certainly, the positioning mechanism may also be in other forms, for example, the positioning mechanism is a positioning magnet arranged on the cover plate. The support rod is provided with an iron block or a passive magnet, and the iron block or the passive magnet is attracted to the positioning magnet after the support rod is flipped around the upper end of the support rod.

The remaining structures and implement manners of the present embodiment are the same as that of Embodiment 1 or Embodiment 2 or Embodiment 3 or Embodiment 4.

In Embodiment 6, referring to FIGS. 24-28, in the present embodiment, the flexible grip 28 is detachably arranged on the upper frame 2, and the grip 28 at least partially covers the outside of the upper frame 2. Preferably, the grip 28 completely wraps the outside of the upper frame 2, so that there will be a better hand feeling when the foot bath device is grasped by the grip 28.

The significance that the grip 28 is detachably installed on the upper frame 2 is as follows: the size of the folded foot bath device is already relatively small after the basin wall 4 is folded, but the grip 28 is removed and placed into the folded basin wall for further reducing the size of the product. Although the reduced size is roughly equivalent to the thickness of the grip 28, the reduced size is important in selling on the e-commerce platform, which can not only further reduce the size of the product to reduce the packaging size, but also leave an adjustable space for the packaging size of the product to meet the requirements of the packaging size of the e-commerce platform.

In the present embodiment, the upper frame 2 is provided with the groove 39, and the grip is arranged in the groove 39, so that the overall size of the product is further reduced after removing the grip 28.

The mode of the detachable connection between the upper frame 2 and the grip 28 is not limited, as long as the grip 28 can be removed. In the present embodiment, the grip 28 is connected to the upper frame 2 by a buckle. Certainly, velcro connection, screw connection, thread connection, and other mode may also be adopted.

In the present embodiment, the specific buckle connection structure between the grip 28 and the upper frame 2 is as follows: the buckle 31 is arranged on the grip 28, and the grip 28 is clamped and fixed on the upper frame 2 by the buckle 31 (Certainly, a buckle may also be arranged on the upper frame, so as to be clamped on the grip to fix the grip).

In order to further facilitate the buckle connection, the elastic sheet 30 is arranged on the grip 28, and the buckle 31 is arranged on the elastic sheet. The elastic sheet 30 may be formed as follows: slits are formed in the grip 28, and the elastic sheet 30 is formed between two slits. The number of the elastic sheet 30 is two in the present embodiment, and each elastic sheet 30 is provided with the buckle 31. The intermediate hook 32 is arranged between the two elastic sheets 30, and the intermediate hook 32 is clamped on the upper frame 2.

In the present embodiment, the grip 28 has the out-extending grasping part 33. The elastic sheet 30 is located inside the grasping part 33 for further convenient grasping.

In the present embodiment, the grip 28 and the upper frame 2 are connected to each other by a vertical slide rail to further stabilize the grip 28 and facilitate installation. The specific structure of the slide rail for connection in the present embodiment is as follows: the grip 28 is provided with the slide bar 34, the upper frame 2 is provided with the slide groove 35, and the slide bar 34 slides into the slide groove 35. The cross sections of the slide groove 35 and the slide bar 34 in the present embodiment are T-shaped.

The remaining structures and implement manners of the present embodiment are the same as that of Embodiment 1 or Embodiment 2 or Embodiment 3 or Embodiment 4 or Embodiment 5.

What is claimed is:

1. A foldable foot bath device, comprising a support rod, an upper frame, a base, and a basin wall connected between the upper frame and the base; wherein a cover plate is arranged on the upper frame; the basin wall is made of a flexible material and is foldable;

when the basin wall is unfolded to form a foot bath area, the basin wall is supported by the support rod to prevent a collapse of the basin wall;

the support rod, when the basin wall is unfolded to form the foot bath area, is located in a space surrounded by the basin wall, and an upper end of the support rod is rotatably connected to the cover plate;

the support rod is supported between the cover plate and a bottom side of the base after the basin wall is unfolded, thereby supporting for the basin wall; and the support rod is configured to be flipped and to approach the cover plate when the basin wall is folded, to make space for folding of the basin wall.

2. The foldable foot bath device according to claim 1, wherein a lower end of the support rod is a free end, and the lower end of the support rod is configured to be supported on the bottom side of the base when the basin wall is unfolded; and the support rod is configured to be flipped around the upper end of the support rod and to approach the cover plate when the basin wall is folded.

3. The foldable foot bath device according to claim 2, wherein the support rod is configured to be disposed below the cover plate when the support rod is flipped around the upper end of the support rod.

4. The foldable foot bath device according to claim 3, wherein a positioning mechanism is arranged on the cover plate, and the positioning mechanism is configured to position the support rod when the support rod is flipped around the upper end of the support rod.

5. The foldable foot bath device according to claim 2, wherein the support rod is configured to be disposed above the cover plate when the support rod is flipped around the upper end of the support rod.

6. The foldable foot bath device according to claim 5, wherein an upper surface of the cover plate includes a receiving groove, and the support rod is configured to be disposed in the receiving groove when the support rod is flipped around the upper end of the support rod.

7. The foldable foot bath device according to claim 5, wherein a positioning mechanism is arranged on the cover plate, and the positioning mechanism is configured to position the support rod when the support rod is flipped around the upper end of the support rod.

8. The foldable foot bath device according to claim 2, wherein the support rod comprises a plurality of sub-rods, and the plurality of sub-rods are rotatably connected to each other end to end.

9. The foldable foot bath device according to claim 2, wherein a positioning mechanism is arranged on the cover plate, and the positioning mechanism is configured to position the support rod when the support rod is flipped around the upper end of the support rod.

10. The foldable foot bath device according to claim 9, wherein the positioning mechanism is a clamping slot arranged on the cover plate, and the support rod is configured to be clamped into the clamping slot when the support rod is flipped around the upper end of the support rod;

or, the positioning mechanism is a positioning magnet arranged on the cover plate, the support rod includes an iron block or a passive magnet, and the iron block or the passive magnet is configured to be attracted to the positioning magnet when the support rod is flipped around the upper end of the support rod.

11. The foldable foot bath device according to claim 1, wherein the support rod is a retractable rod, and the retractable rod is configured to be elongated when the basin wall is unfolded; and the retractable rod is configured to be shortened when the basin wall is folded.

12. The foldable foot bath device according to claim 1, wherein the support rod comprises a plurality of sub-rods rotatably connected to each other end to end, and a lower end of the support rod is rotatably connected to the bottom side of the base.

13. The foldable foot bath device according to claim 1, wherein the support rod is longitudinally rotatably connected to the cover plate.

14. The foldable foot bath device according to claim 1, wherein the support rod is laterally rotatably connected to the cover plate.

15. The foldable foot bath device according to claim 14, wherein the support rod is movably connected to an edge of the cover plate.

16. The foldable foot bath device according to claim 15, wherein the support rod is a first support rod and the foldable foot bath device comprises a second support rod, and the first and second support rods are movably connected to a left edge of the cover plate and a right edge of the cover plate, respectively.

17. The foldable foot bath device according to claim 1, wherein a flexible grip is detachably arranged on the upper frame, and the flexible grip at least partially covers an outside of the upper frame.

18. The foldable foot bath device according to claim 17, wherein the upper frame includes a groove, and the flexible grip is arranged in the groove.

19. The foldable foot bath device according to claim 1, wherein a water spraying channel is arranged in the support rod, and a lower end of the support rod includes a water inlet communicating with the water spraying channel; at least one water spraying nozzle communicating with the water spraying channel is arranged on the support rod, and a water spraying mechanism is arranged in the base; and the water spraying mechanism is configured to communicate with the water inlet when the support rod is supported on the bottom side of the base.

* * * * *